US009235996B2

(12) United States Patent
Abadi

(10) Patent No.: US 9,235,996 B2
(45) Date of Patent: Jan. 12, 2016

(54) MULTI-PANELED SIGNAGE SUBSTRATE AND METHOD FOR MAKING THE SAME

(71) Applicant: Image Microsystems, Inc., Austin, TX (US)

(72) Inventor: Alex Abadi, Austin, TX (US)

(73) Assignee: Image Microsystems, Inc., Austin, TX (US)

( * ) Notice: Subject to any disclaimer, the term of this patent is extended or adjusted under 35 U.S.C. 154(b) by 0 days.

(21) Appl. No.: 14/155,348

(22) Filed: Jan. 14, 2014

(65) Prior Publication Data

US 2014/0196329 A1 Jul. 17, 2014

Related U.S. Application Data

(60) Provisional application No. 61/752,020, filed on Jan. 14, 2013.

(51) Int. Cl.

| | |
|---|---|
| ***G09F 7/00*** | (2006.01) |
| ***G09F 13/00*** | (2006.01) |
| ***G09F 15/00*** | (2006.01) |
| *G09F 7/18* | (2006.01) |

(52) U.S. Cl.

CPC ..... *G09F 13/00* (2013.01); *G09F 15/0018* (2013.01); *G09F 2007/1878* (2013.01); *Y10T 29/49947* (2015.01)

(58) Field of Classification Search

CPC ..... G09F 15/0006
USPC ..... 40/612, 605, 624, 610; 52/465
See application file for complete search history.

(56) References Cited

U.S. PATENT DOCUMENTS

| | | | | |
|---|---|---|---|---|
| 1,755,360 | A * | 4/1930 | Olmsted | 40/624 |
| 2,885,808 | A * | 5/1959 | Bastis | 40/624 |
| 4,461,131 | A * | 7/1984 | Pressell | 52/395 |
| 5,298,214 | A | 3/1994 | Morrow et al. | |
| 5,772,041 | A | 6/1998 | Kertscher et al. | |
| 6,007,005 | A | 12/1999 | Gonzales et al. | |
| 6,013,685 | A | 1/2000 | Pauls | |
| 6,342,539 | B1 | 1/2002 | Chapman | |
| 7,062,872 | B2 * | 6/2006 | Williams et al. | 40/586 |
| 7,902,262 | B2 | 3/2011 | Armstrong et al. | |
| 2003/0199596 | A1 | 10/2003 | Koike et al. | |

(Continued)

FOREIGN PATENT DOCUMENTS

| | | |
|---|---|---|
| DE | 43 23 217 C1 | 4/1994 |
| EP | 1 226 913 A1 | 7/2002 |

*Primary Examiner* — Joanne Silbermann
(74) *Attorney, Agent, or Firm* — John A. Fortkort; Fortkort & Houston P.C.

(57) ABSTRACT

An article (101) is provided which includes a plurality of panels (103), wherein each panel comprises a first edge having a first longitudinally extending protrusion (107) adjacent thereto and a second edge having a second longitudinally extending protrusion (109) adjacent thereto, wherein each of the first and second protrusions has a planar exterior surface (131) and an interior surface (133) having an indentation (135) therein, and wherein the plurality of panels are arranged in an abutting manner such that the planar exterior surface of at least one first protrusion and at least one second protrusion are disposed in an opposing relation to each other. A coupler (113) is also provided which extends over said first and second protrusions. The coupler is equipped with at least a first protuberance (145) which engages the indentation on the interior surface of the first protrusion.

28 Claims, 8 Drawing Sheets

(56) References Cited

U.S. PATENT DOCUMENTS

| | | | |
|---|---|---|---|
| 2009/0126294 | A1 | 5/2009 | Lovald et al. |
| 2009/0301021 | A1 | 12/2009 | Jenny |
| 2010/0319144 | A1 | 12/2010 | Nosker et al. |
| 2011/0120037 | A1 | 5/2011 | Barlow |
| 2011/0294390 | A1 | 12/2011 | Michalk et al. |
| 2011/0294917 | A1 | 12/2011 | Lynch et al. |
| 2012/0011791 | A1 | 1/2012 | Lach |
| 2012/0304931 | A1 | 12/2012 | Bagatur et al. |

* cited by examiner

MULTI-PANELED SIGNAGE SUBSTRATE AND METHOD FOR MAKING THE SAME

CROSS-REFERENCE TO RELATED APPLICATION

This application claims the benefit of priority from U.S. provisional application No. 61/752,020, filed Jan. 14, 2013, having the same inventor and the same time, and which is incorporated herein by referenced in its entirety.

FIELD OF THE DISCLOSURE

The present disclosure relates generally to multi-paneled articles, and more particularly to multi-paneled signage substrates and methods for making the same.

BACKGROUND OF THE DISCLOSURE

The use of signage has become ubiquitous in modern society. This is especially true on roadways, where signage is used to direct and regulate traffic, provide navigational aids and information, warn motorists of potential hazards, and for various other purposes.

Due to their sheer numbers, roadway signs present significant resource consumption issues. For example, by the mid-1990s, about $250 million was being spent annually in the U.S. to maintain 58 million traffic signs spread over 3.8 million miles of roads, streets and highways. Aluminum (typically in the form of alloy grades 6061, 5052 and 3000) and wood have traditionally been the most commonly used substrates for signage applications.

SUMMARY OF THE DISCLOSURE

Figure 1:
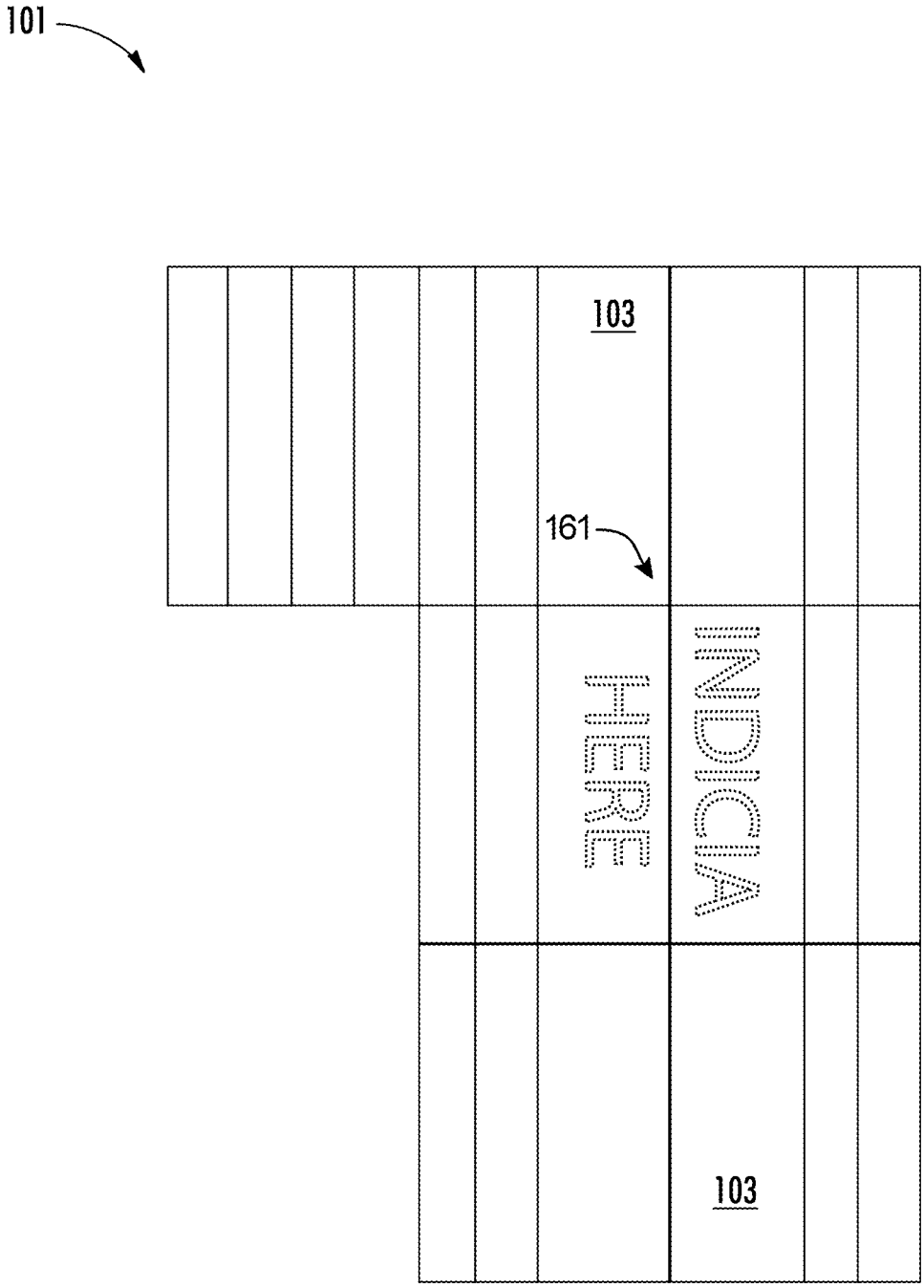
FIG. 1 is an illustration of the front side of a multi-panel article in accordance with the teachings herein.

In one aspect, an article is provided which comprises (a) a plurality of panels, wherein each panel comprises a first edge having a first longitudinally extending protrusion adjacent thereto and a second edge having a second longitudinally extending protrusion adjacent thereto, wherein each of said first and second protrusions has a planar exterior surface and an interior surface having an indentation therein, and wherein said plurality of panels are arranged in an abutting manner such that the planar exterior surface of at least one first protrusion and at least one second protrusion are disposed in an opposing relation to each other; and (b) a coupler which extends over said first and second protrusions, wherein said coupler is equipped with a first protuberance which engages the indentation on the interior surface of said first protrusion.

In another aspect, a method is provided for making an article. The method comprises (a) providing a plurality of panels, wherein each panel comprises a first edge having a first longitudinally extending protrusion adjacent thereto and a second edge having a second longitudinally extending protrusion adjacent thereto, and wherein each of said first and second protrusions has a first planar surface and a second indented surface; (b) arranging the panels in an abutting manner such that the planar surface of at least one first protrusion and at least one second protrusion are disposed in an opposing relation to each other; and (c) applying a coupler to said first and second protrusions, wherein said coupler extends over said first and second protrusions and is equipped with a first protuberance which engages the indented surface of said first protrusion.

In a further aspect, an article is provided which comprises (a) a plurality of panels, wherein each panel comprises a first edge having a first longitudinally extending protrusion adjacent thereto and a second edge having a second longitudinally extending protrusion adjacent thereto, wherein each of said first and second protrusions are arranged in an abutting manner such that said first protrusion and said second protrusion are disposed in an opposing relation to each other, and wherein said first protrusion is equipped with an indented surface; and (b) a coupler which extends over said first and second protrusions, wherein said coupler is equipped with a first protuberance which engages the indented surface of said first protrusion.

DETAILED DESCRIPTION

At present, e-waste (waste from electronic products) is growing faster than any other type of waste, with an annual volume close to 40 million metric tons (88,200,000,000 pounds) globally. Such growth is expected to increase. Indeed, a 2010 UN study concluded that e-waste is likely to grow exponentially over existing levels, to as much as 500 times over the coming decade. This is equivalent to over 44,100,000,000,000 lbs of e-waste.

Plastics account for 23% of all e-waste. Unfortunately, the plastic in e-waste is not environmentally friendly, because it contains UV inhibitors and brominated flame retardants. These additives render such plastics virtually non-biodegradable in landfills.

Recently, some attempts have been made to create useful products out of e-waste. For example, commonly assigned U.S. Ser. No. 13/109,545 (Abadi et al.), entitled "PLASTIC RECYCLING METHOD AND MANUFACTURING PRODUCT", (which is incorporated herein by reference in its entirety) discloses the use of recycled plastics, such as ABS, in the manufacture of various articles, including signage substrates. This application leverages the inherent UV stability and flame resistance of the waste stream material to make useful products. In doing so, it converts an environmental liability to a useful feedstock, while offering a variety of other advantages associated with recycling.

Despite the many advantages of the foregoing process, further improvements are required. For example, practical limitations exist with respect to the size of articles that can be generated by this process due, for example, to commonly available die sizes and processing equipment limitations. These limitations make it difficult to cast articles having a major dimension larger than about 3-4 feet from recycled plastics. However, it is frequently desirable to create larger articles than this, especially in signage applications. By way of example, highway signs having heights of 42", 56" or larger are common, and many highway signs have widths which are considerably larger than their heights (the actual widths are variable and dictated by the amount of lettering required and other such considerations).

It has now been found that the foregoing limitations may be overcome through the provision of a plurality of interlocking panels that may be connected together to provide a signage substrate or other article. The panels are preferably fabricated from recycled plastics, and may be made in small enough sizes to accommodate conventional processing equipment. In a preferred embodiment, the design of the panels allows them to be readily assembled together to form various rigid multi-paneled articles which have a planar surface suitable for imaging.

Figure 2:
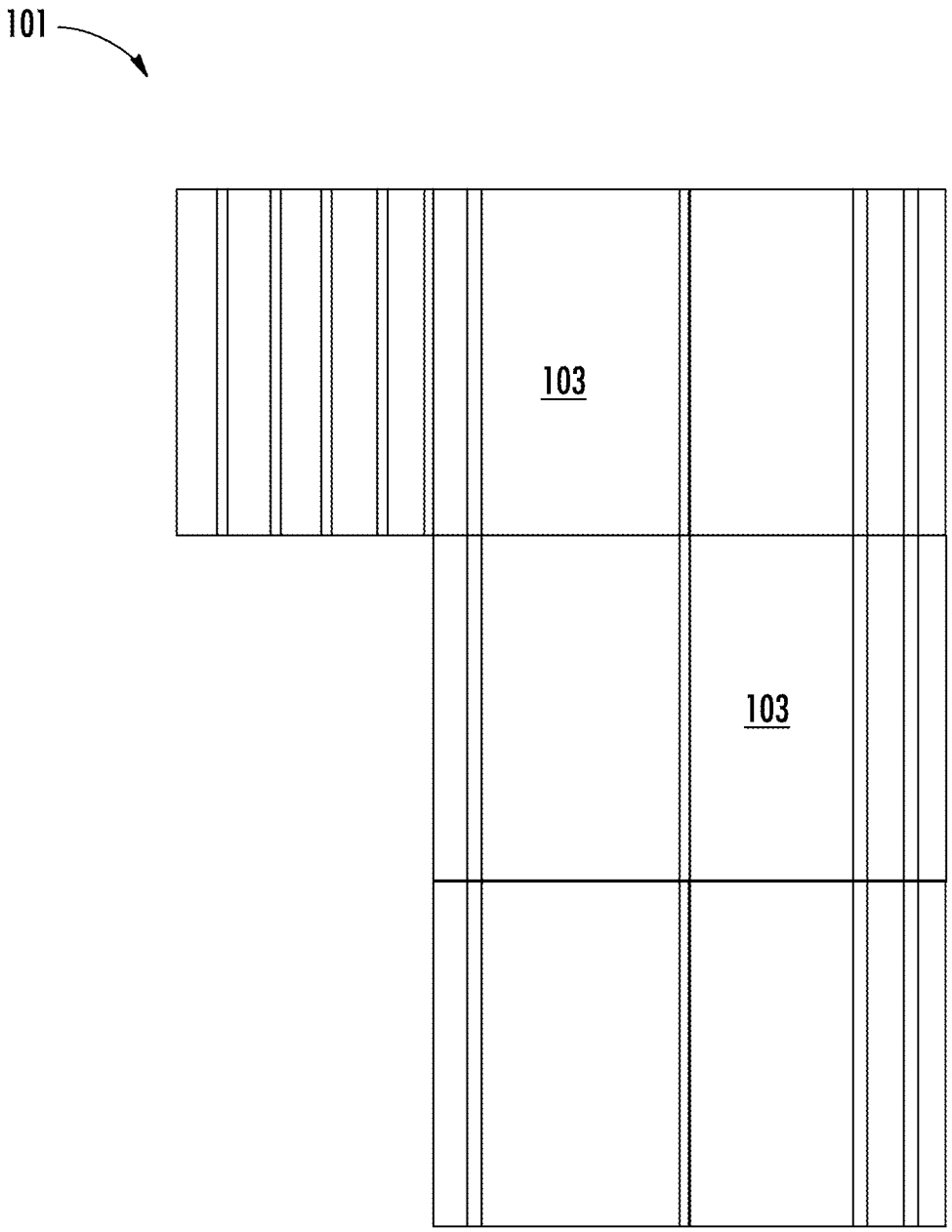
FIG. 2 is an illustration of the back side of the multi-panel article of FIG. 1.

The devices and methodologies disclosed herein may be further appreciated with respect to FIGS. 1-8, which depict a first particular, non-limiting embodiment of a multi-paneled article, and a method for making the same, in accordance with the teachings herein. As seen in FIGS. 1-2, the multi-paneled article 101 in the particular embodiment depicted consists of a plurality of panels 103 that are assembled into a desired construct by adjoining them laterally.

Figure 4:
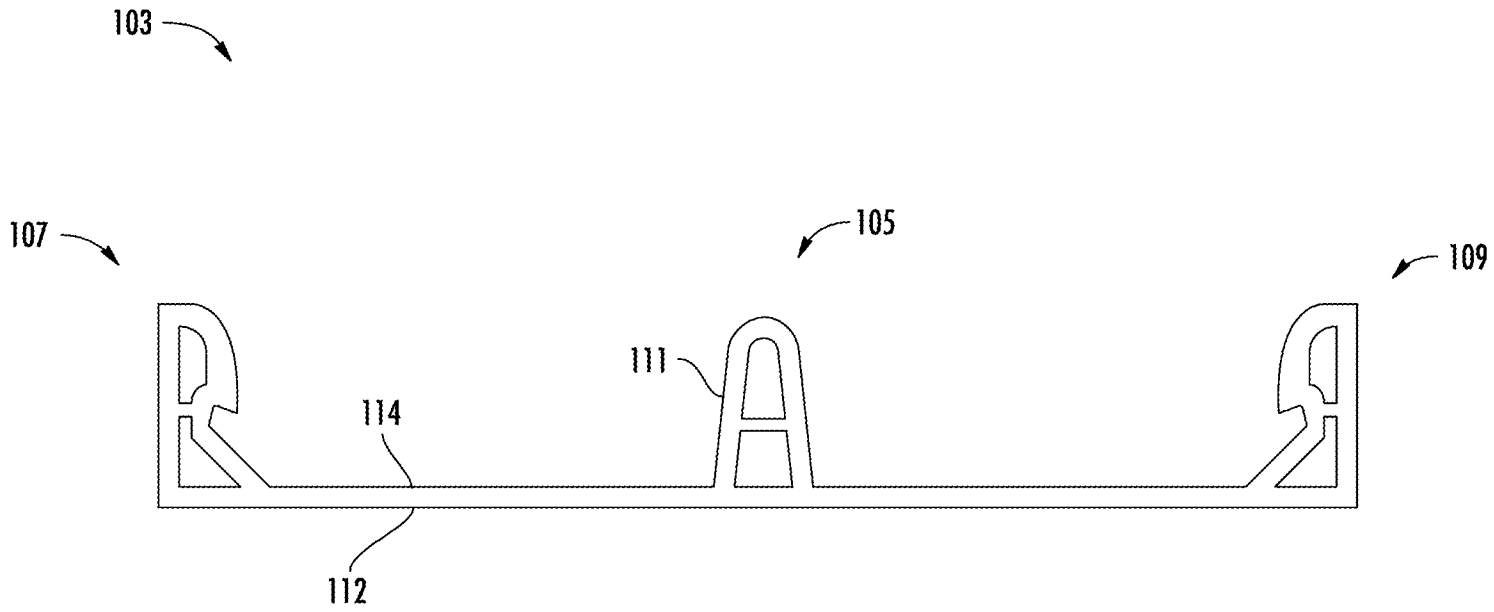
FIG. 4 is a side view of an individual panel from the multi-panel article of FIG. 1.

The profile of the individual panels 103 may be appreciated with respect to FIG. 4. As seen therein, each panel 103 is equipped with a plurality of longitudinal protrusions (denoted collectively by 105) or ridges. In the particular embodiment depicted, these protrusions 105 include a first terminal protrusion 107 which is disposed along a first edge of the panel 103, a second terminal protrusion 109 which is disposed along a second end of the panel 103, and one or more interior protrusions 111 which are disposed between the first 107 and second 109 protrusions. The first 107 and second 109 terminal protrusions in the depicted embodiment are essentially R-shaped in cross-sectional profile and are mirror images of each other, and the interior protrusions 111 are essentially A-shaped in cross-sectional profile. Of course, one skilled in the art will appreciate that various embodiments may be made in accordance with the teachings herein that contain varying numbers of protrusions, and these protrusions may have various profiles or various dimensions, and may be arranged in various ways. Notably, the panel 103 has a first major surface 112 which is preferably planar or essentially planar, and an opposing second major surface 114 which has the protrusions 105 disposed thereon.

Figure 3:
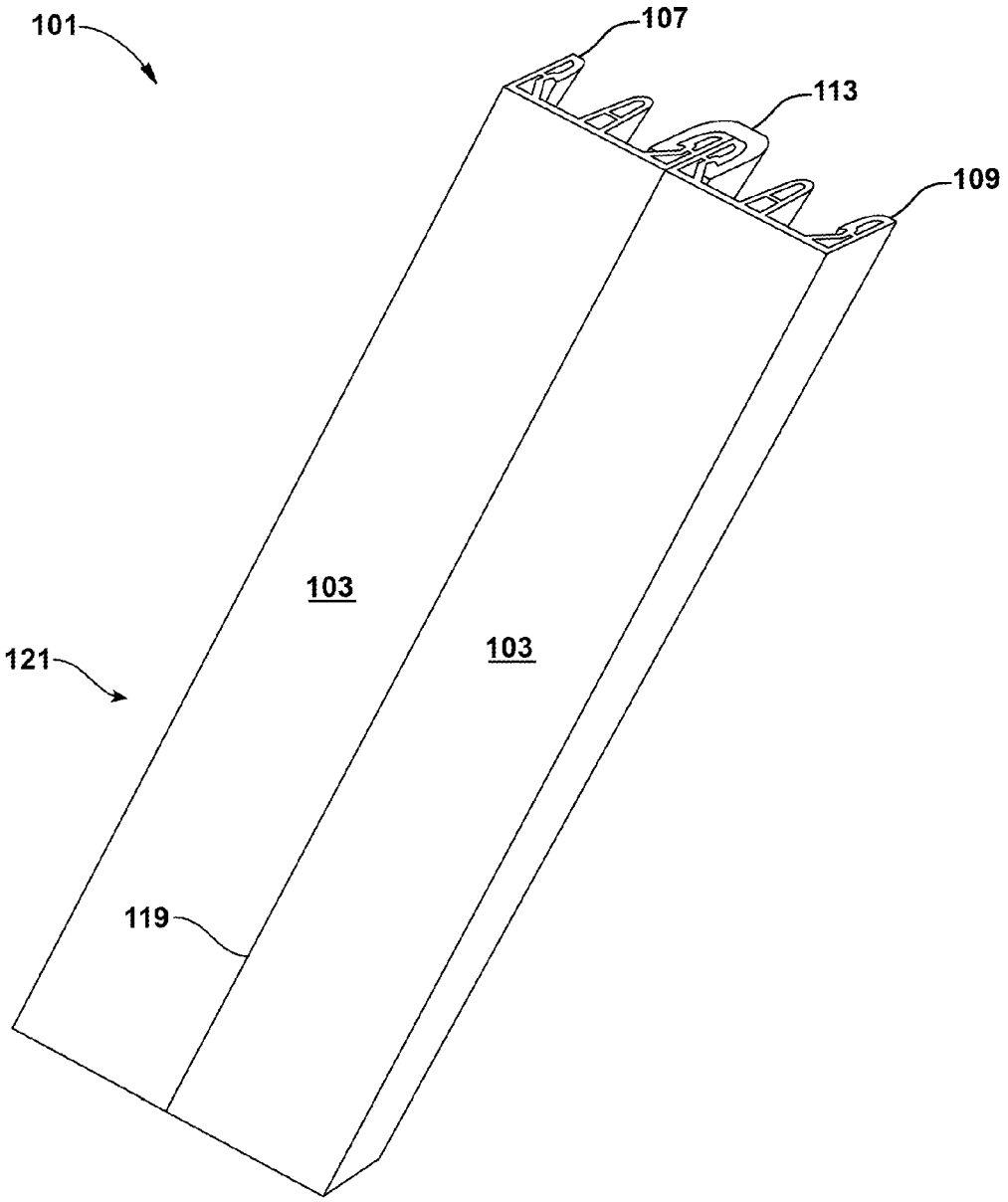
FIG. 3 is a perspective view of two of the panels from the multi-panel article of FIG. 1.
Figure 7:
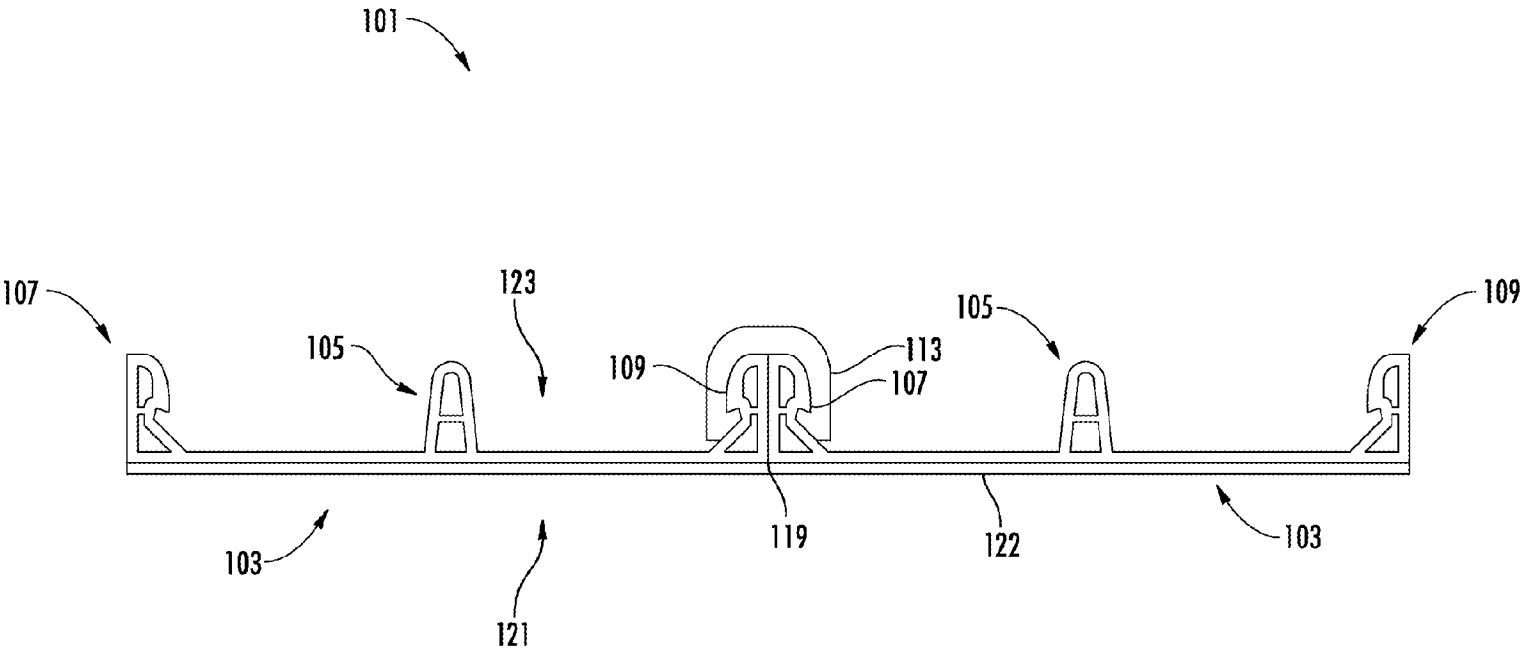
FIG. 7 depicts a multi-paneled article assembled with the use of the coupler of FIG. 6.
Figure 8:
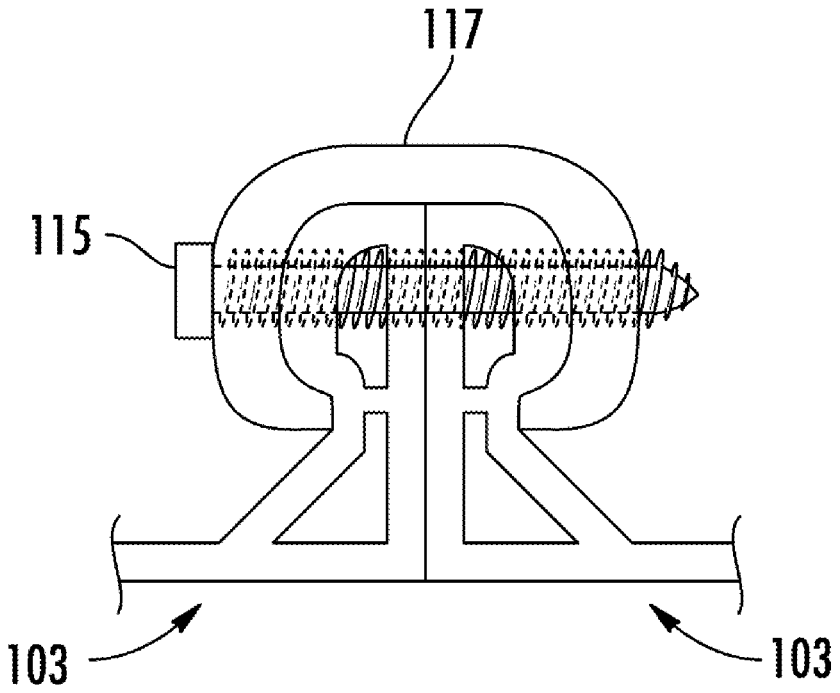
FIG. 8 depicts the use of an optional fastener to hold the coupler of FIG. 6 in place after it is placed over a pair of adjacent protrusions.

The manner in which panels 103 may be adjoined to form a multi-paneled article may be appreciated with respect to FIGS. 7-8. As seen therein, the panels 103 are arranged in an abutting manner such that a first terminal protrusion 107 and a second terminal protrusion 109 are disposed in an opposing and abutting relation to each other. A coupler 113 is then applied to the abutting first 107 and second 109 terminal protrusions to bind them together, thus securing the panels 103 in an abutting relation to each other. As seen in FIG. 8, in some applications, an optional fastener 115 (which may be, for example, a screw, nail, clip, pin, or other threaded or non-threaded fastener or element) may be utilized to maintain the coupler in place. As seen in FIGS. 3 and 7, in the resulting article 101, the panels 103 are adjoined across a tight seam 119 on a first (preferably planar or essentially planar) surface 121 of the article 101, with the protrusions 105 on a second surface 123 of the article 101.

In the particular embodiment depicted in FIG. 3, the first surface 121 is planar, thus rendering the article 101 useful as a signage blank or for other applications where such a surface is required. Of course, it will be appreciated that, in alternative embodiments, an article having a non-planar first surface 121 may be achieved by using panels 103 that have a non-planar surfaces, or which couple to each other at an angle other than 180°. By way of example, the panels 103 may be equipped with a first surface 112 (see FIG. 4) which has a curved, polygonal, irregular, or other desired profile.

Figure 5:
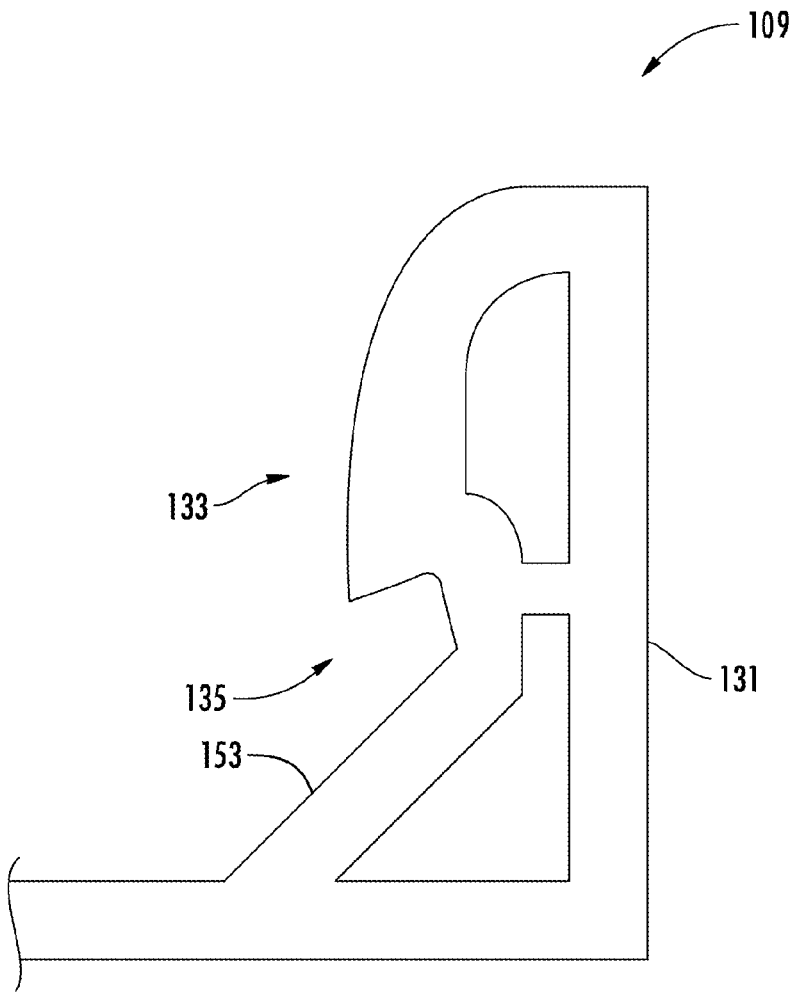
FIG. 5 is a magnified view depicting the profile of one of the longitudinal protrusions on the panel of FIG. 4.
Figure 6:
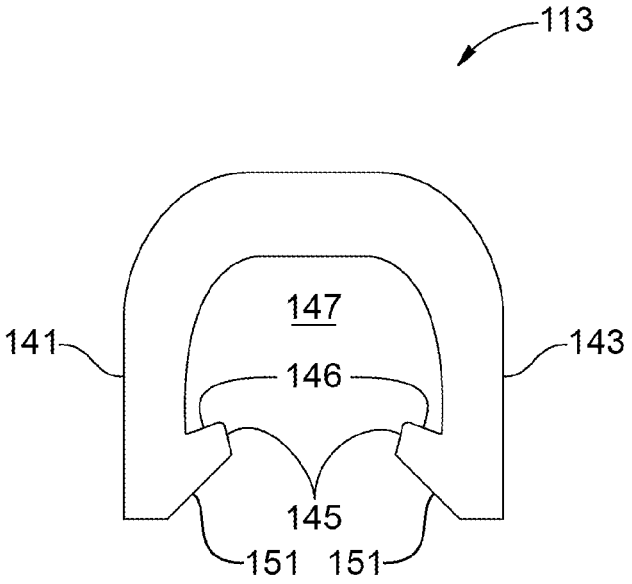
FIG. 6 is a magnified view depicting the profile of a longitudinal coupler from FIG. 4 which extends over pairs of adjacent protrusions in a multi-paneled article and may be utilized to adjoin adjacent panels together.

The manner in which the coupler 113 attaches to the protrusions 105 may be understood with greater specificity by reference to FIGS. 5-6, which show, respectively, the detailed profile of the protrusion 109 (protrusion 107 is a mirror image) and the coupler 113. With reference thereto, each of protrusions 107 and 109 in this particular embodiment has a first surface 131 which is planar, and a second opposing surface 133 which is equipped with an indentation 135. The protrusions 105 in this particular embodiment are hollow to reduce the weight of the article and reduce manufacturing costs, though one skilled in the art will appreciate that solid protrusions could be used as well in some applications.

The coupler 113 is essentially U-shaped, and consists of first 141 and second 143 opposing (and preferably resilient) walls, each of which terminates in a prong 145. The prongs 145 are preferably complimentary in shape to the indentations 135 on the coupler 113 (see FIG. 5). Moreover, the area 147 encompassed within the coupler 113 is preferably complimentary in shape to the profile formed by two protrusions 105 when their first planar surfaces 131 are in abutment (see FIG. 5). Consequently, when the coupler 113 is placed over the abutting protrusions 105, the prongs 145 snap into place into the indentations 135, thus securing the coupler 113 in place. In so doing, the first flat regions 151 on each prong 145 (see FIG. 6) of the coupler 113 pressingly engage second flat regions 153 on the indented surfaces of each protrusion 109 (see FIG. 5).

Various materials may be utilized in the devices and methodologies described herein. However, the use of plastics or polymeric materials is preferred, and the use of recycled plastics (especially thermoplastics) or polymeric materials is especially preferred. Such materials may include acrylonitrile-butadiene-styrene (ABS), polycarbonate, polystyrene, styrene-acrylonitrile (SAN), polyvinylchloride (PVC), acetal, nylon, polyethylene, polypropylene, polyesters polyvinylchloride (PVC), acrylics, fluoropolymers and polymides. Mixtures and copolymers of the foregoing materials may also be used in the devices and methodologies described herein. Any portion or component (including the couplers) may be made partially or wholly out of the foregoing materials, though in some embodiments, the couplers may also comprise various metals.

The use of ABS, and especially recycled ABS, in the devices and methodologies described herein is especially preferred. Suitable ABS resins include, for example, general purpose high gloss grade ABS resins having a melt flow rate (MFR) of 6.0 g/10 min (3.8 kg, 230° C.) and an Izod impact strength of 5.5 ft-lb/in. ABS is commonly used to form rigid computer parts, such as computer and printer housings, and ink cartridges. Hence, ABS represents a significant waste stream that is available in large volumes. Moreover, ABS resists biodegradation due to the flame retardants and UV inhibitors it is typically compounded with, and hence presents disposal and landfill issues. The devices and methodologies disclosed herein advantageously utilize these properties in applications such as signage, and thus turn an environmental liability into useful products.

As noted above, the polymeric materials used in the devices and methodologies described herein may contain various flame retardants. Such flame retardants may include various halogenated materials such as, for example, tetrabromobisphenol-A (TBAA), 1,2-bis(2,4,6-tribromophenoxy) ethane (TBPE) or octabromodiphenyl oxide (OBDPO). These flame retardants may be used in various amounts, but are typically used in amounts in the range of about 5% to about 40%, preferably in the range of about 10% to about 30%, more preferably in the range of about 10% to about 25%, and most preferably in the range of about 15% to about 17%, based on the total weight of the formulation. The polymeric materials may also contain one or more UV stabilizers.

The polymeric materials used in the devices and methodologies described herein may also contain various metal oxides. Some of these metal oxides may provide a synergistic effect with the foregoing flame retardants and thus reduce the amount of flame retardant required, which in turn can give rise to polymeric compositions having improved physical properties. Examples of such materials may include antimony pentoxide (such as that available commercially under the designation BurnEx ADP494) and antimony trioxide. These materials may be utilized in various amounts. ABS polymers compounded with bromine-containing flame retardants, the antimony pentoxide or antimony trioxide is preferably formulated at mole ratios of 3:1 and 4:1 (bromine:antimony).

While virgin polymeric materials used in the devices and methodologies described herein may be compounded with the above noted materials, recycled materials may already contain these additives. In this case, it is preferred to process these materials in a way that will avoid loss of these materials. For example, U.S. Ser. No. 13/109,545 (Abadi et al.), which has been referenced above, discloses methods for processing recycled ABS and other materials which avoids volatilization of the flame retardants these materials contain, and which may be utilized to produce the articles described herein. These methods may involve processing the recycled materials at lower temperatures (e.g., over the glass transition temperature of the recycled polymers) and possibly under pressure).

While the foregoing description has described the inventive articles and methodologies primarily with respect to flat panels, one skilled in the art will appreciate that various articles of various shapes may also be produced through suitable application or modification of the principles disclosed herein. For example, connector pieces of various shapes and configurations may be utilized in combination with the panels described herein to achieve articles having various shapes. By way of example, connector pieces (which may essentially be a panel of the type described herein, but bent or curved at a given angle such as, for example, 45°, 60° or 90°) may be used in conjunction with the foregoing panels to achieve multi-panel articles having various configurations.

It will further be appreciate that the articles produced in accordance with the methods described herein are not limited to signage. By way of example (but not limitation), such articles may include plastic pavers, decking, wall coverings, playground structures, and the like.

It will also be appreciated that the articles produced in accordance with the teachings herein may be subjected to further processing to produce various products. For example, signage may be created from these articles by applying reflective sheeting, reflective layers or indicia (both shown generally as element 122 in FIG. 7), lettering, UV protective layers, and other suitable components. In some applications, the substrate may have to be primed, roughened, or otherwise prepared prior to the application of these materials.

It will also be appreciated that the articles produced in accordance with the teachings herein may be derived from polymers that have been mixed or compounded with various dyes, pigments, colorants, fillers, stabilizers, plasticizers, surfactants and other additives as are known to the art. These may include, without limitation, carbon black, titanium dioxide, and/or various metal powders or particles.

It will also be appreciated that the articles produced in accordance with the teachings herein may include various films, powders or inks which may be applied to one or more surfaces thereof for various purposes. For example, films with printing, artwork or indicia 161 (see FIG. 1) may be applied to blank signage substrates produced in accordance with the methodologies described herein.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. An article, comprising:

a plurality of panels, wherein each panel comprises a first edge having a first longitudinally extending protrusion adjacent thereto and a second edge having a second longitudinally extending protrusion adjacent thereto, wherein each of said first and second protrusions has a first surface and a second indented surface, and wherein said plurality of panels are arranged in an abutting manner such that the first surface of at least one first protrusion and at least one second protrusion are disposed in an opposing relation to each other; and a coupler which extends over said first and second protrusions, wherein said coupler is equipped with a first protuberance which engages the indented surface of said first protrusion, and a second protuberance which engages the indented surface of said second protrusion;

wherein each of said plurality of panels has a first major surface which is planar, and wherein the indented surface of each protrusion includes a flat region which slopes away from said first major surface in the direction of said first surface.

2. The article of claim 1, wherein said coupler has first and second opposing walls, wherein said first protuberance is disposed on said first wall, and wherein said second protuberance is disposed on said second wall.

3. The article of claim 2, wherein said coupler is U-shaped in a cross-section taken in a plane perpendicular to the longitudinal axis of said coupler.

4. The article of claim 2, wherein each of said first and second protuberances contains a first flat region, wherein the indented surface of each of said first and second protrusions contains a second flat region, and wherein the coupler engages said first and second protrusions such that the first flat regions of said first and second protuberances pressingly engage the second flat regions of said first and second protrusions.

5. The article of claim 2, wherein each of said plurality of panels has a first major surface which is planar, wherein said coupler has an interior which is complimentary in shape to the combined shape of said first and second protrusions when said plurality of panels are arranged in an abutting manner such that the first exterior surface of at least one first protrusion and at least one second protrusion are disposed in an opposing relation to each other and such that the first major surfaces of the plurality of panels are coplanar.

6. The article of claim 1, wherein each of said plurality of panels has a first major surface which is planar, and wherein each of said plurality of panels has a second major surface having said first and second protrusions disposed thereon.

7. The article of claim 6, wherein said first major surface is rectangular, and wherein said first and second protrusions have longitudinal axes that are parallel to the major axis of said first major surface.

8. The article of claim 1, wherein the first surfaces of the first and second protrusions are planar and face outward from the panel, and wherein the second indented surfaces face inward.

9. The article of claim 1, wherein each of said plurality of panels has a first major surface, wherein said plurality of panels are arranged in an abutting manner such that the first major surfaces of said plurality of panels forms a substrate, and further comprising an indicia disposed over said substrate.

10. The article of claim 9, wherein said substrate is planar.

11. The article of claim 9, wherein said article is a traffic sign.

12. The article of claim 9, further comprising a reflective layer.

13. The article of claim 1, wherein each protrusion is R-shaped in cross-section.

14. The article of claim 1, wherein said coupler has first and second opposing sides, wherein said first side has said first protuberance thereon and said second side has said second protuberance thereon, wherein said first protuberance has a longitudinal axis that extends toward said second side in a direction away from said plurality of panels, and wherein said second protuberance has a longitudinal axis that extends toward said first side in a direction away from said plurality of panels.

15. The article of claim 1, wherein said coupler has first and second opposing arms, wherein said first protuberance is disposed on said first arm and has a first flat region thereon which extends from said first arm in a direction away from said plurality of panels, and wherein said second protuberance is disposed on said second arm and has a second flat region thereon which extends from said second arm in a direction away from said plurality of panels.

16. The article of claim 15, wherein said first indented surface is complimentary in shape to said first protuberance, wherein said second indented surface is complimentary in shape to said second protuberance, and wherein each of said first and second protrusions has an arcuate surface which abuts the indented surface at an acute angle.

17. A method for making an article, comprising:

providing a plurality of panels, wherein each panel comprises a first edge having a first longitudinally extending protrusion adjacent thereto and a second edge having a second longitudinally extending protrusion adjacent thereto, and wherein each of said first and second protrusions has a first surface and a second indented surface;

arranging the panels in an abutting manner such that the planar surface of at least one first protrusion and at least one second protrusion are disposed in an opposing relation to each other; and applying a coupler to said first and second protrusions, wherein said coupler extends over said first and second protrusions and is equipped with a first protuberance which engages the indented surface of said first protrusion, and a second protuberance which engages the indented surface of said second protrusion;

wherein said coupler has first and second opposing walls, wherein said first protuberance is disposed on said first wall, and wherein said second protuberance is disposed on said second wall, wherein each of said first and second protuberances contains a first flat region, wherein the indented surface of each of said first and second protrusions contains a second flat region, and wherein the coupler engages said first and second protrusions such that the first flat region of said first protuberance pressingly engages the second flat region of said first protrusion, and such that the first flat region of said second protuberance pressingly engages the second flat region of said second protrusion.

18. The method of claim 17, wherein said coupler has first and second opposing walls, wherein said first protuberance is disposed on said first wall, and wherein said second protuberance is disposed on said second wall.

19. The method of claim 18, wherein said coupler is U-shaped in a cross-section taken in a plane perpendicular to the longitudinal axis of said coupler.

20. The method of claim 18, wherein each of said plurality of panels has a first major surface which is planar, wherein said coupler has an interior which is complimentary in shape to the combined shape of said first and second protrusions when said plurality of panels are arranged in an abutting manner such that the planar exterior surface of at least one first protrusion and at least one second protrusion are disposed in an opposing relation to each other and such that the first major surfaces of the plurality of panels are coplanar.

21. The method of claim 17, wherein each of said plurality of panels has a first major surface which is planar, and wherein each of said plurality of panels has a second major surface having said first and second protrusions disposed thereon.

22. The method of claim 21, wherein said first major surface is rectangular, and wherein said first and second protrusions have longitudinal axes that are parallel to the major axis of said first major surface.

23. The method of claim 1, wherein the second flat regions of the first and second protrusions face outward from the panel, and wherein the indented surfaces of the first and second protrusions face inward.

24. The method of claim 17, wherein each of said plurality of panels has a first major surface, wherein said plurality of panels are arranged in an abutting manner such that the first major surfaces of said plurality of panels forms a substrate, and further comprising an indicia disposed over said substrate.

25. The method of claim 24, wherein said substrate is planar.

26. The method of claim 24, wherein said article is a traffic sign.

27. The method of claim 24, further comprising a reflective layer.

28. An article, comprising:

a plurality of panels, wherein each panel comprises a first edge having a first longitudinally extending protrusion adjacent thereto and a second edge having a second longitudinally extending protrusion adjacent thereto, wherein each of said first and second protrusions are arranged in an abutting manner such that said first protrusion and said second protrusion are disposed in an opposing relation to each other, and wherein said first and second protrusions are equipped with an indented surface; and a coupler which extends over said first and second protrusions, wherein said coupler is equipped with first and second protuberances which engage the indented surfaces of said first and second protrusions;

wherein said coupler has first and second opposing sides, wherein said first side has said first protuberance thereon and said second side has said second protuberance thereon, wherein said first protuberance has a longitudinal axis that extends toward said second side in a direction away from said plurality of panels, and wherein said second protuberance has a longitudinal axis that extends toward said first side in a direction away from said plurality of panels.

* * * * *